US005819483A

United States Patent [19]

Wells

[11] Patent Number: 5,819,483

[45] Date of Patent: Oct. 13, 1998

[54] INVERTED GROUND ANCHOR

[76] Inventor: Raymond Wells, P.O. Box 257, Mayo, Fla. 32066

[21] Appl. No.: 723,225

[22] Filed: Sep. 27, 1996

[51] Int. Cl.[6] ..... E02D 5/74

[52] U.S. Cl. ..... 52/166; 52/23; 52/DIG. 9; 52/DIG. 11

[58] Field of Search ..... 52/2.25, 2.26, 52/4, 23, 146, 148, 166, 169.9, DIG. 11, DIG. 9; 405/259.1, 288, 302.2

[56] References Cited

U.S. PATENT DOCUMENTS

| | | | |
|---|---|---|---|
| 448,786 | 3/1891 | Ogden | 52/166 |
| 837,618 | 12/1906 | Fixler et al. | 52/146 |
| 1,249,062 | 12/1917 | Garvin | 52/166 |
| 2,573,987 | 11/1951 | Sage | 52/23 |
| 2,892,518 | 6/1959 | Fiske | 52/166 |
| 3,601,994 | 8/1971 | Galis | 405/288 |
| 3,914,910 | 10/1975 | Struben . | |
| 4,070,802 | 1/1978 | Odom . | |
| 4,180,952 | 1/1980 | Vanderlyn . | |
| 5,355,640 | 10/1994 | Frye | 52/23 |
| 5,384,993 | 1/1995 | Phillips . | |

*Primary Examiner*—Lanna Mai
*Assistant Examiner*—Timothy B. Kang
*Attorney, Agent, or Firm*—Terrance L. Siemens

[57] ABSTRACT

A construction for and method of building a tie-down type ground anchor for securing a structure to supporting ground. A cylindrical block formed from recycled plastic waste has a longitudinal bore and receives a tether through the bore. The tether is knotted at one end. The tether is pulled through the block until the knot lodges thereagainst, thus preventing the tether from being pulled free of the block from the unknotted end. The block is lowered into a hole dug beneath the structure being secured. The block is disposed with the free end of the tether facing away from the structure. The free end of the tether is then tied to the structure after being adequately tightened. The hole is then filled.

3 Claims, 3 Drawing Sheets

INVERTED GROUND ANCHOR

BACKGROUND OF THE INVENTION

1. Field of the Invention

The present invention relates to ground anchors of the dead man type, having a tether for tying down building structures. The novel ground anchor comprises a cylindrical body buried in the ground with the tether emerging from the body in a direction opposite that in which it extends for attachment to the building structure. This orientation subjects the cylindrical body to a torque tending to urge the body to tumble end over end within the soil, which motion is strongly and effectively opposed by the soil.

2. Description of the Prior Art

Ground anchors have long been employed to stabilize a building structure on surrounding ground. Ground anchors, where tethered to the stabilized structure, have been designed for improved resistance to displacement by virtue of great weight, size, and special configuration to improve resistance to subterranean motion. It is particularly desirable to rely upon the last of these characteristics, in order to economize on material and to reduce the labor of construction.

U.S. Pat. Nos. 4,180,952, issued to Donald Vanderlyn on Jan. 1, 1980, and 5,384,993, issued to Belton R. Phillips on Jan. 31, 1995, show ground anchors employing concrete blocks buried in the ground. In each case, a rod projects upwardly from the block for attachment to tethers above ground. By contrast, the present invention comprises a block having a tether connected directly thereto. The rod of the prior art devices is eliminated. Also, the tether emerges from the block at the bottom thereof, and partially winds around the block to extend upwardly. This arrangement of a tether is not seen in the prior art. Moreover, the cylindrical or barrel shape of the block is not disclosed in the prior art.

U.S. Pat. Nos. 3,914,910, issued to Francis L. Struben on Oct. 28, 1975, and 4,070,802, issued to James Thomas Odom on Jan. 31, 1978, both illustrate tie-down anchors having ground engaging members which are forced or propelled into the ground. Both devices have upwardly projecting rods to which tethers are attached above ground level. By contrast, the present invention comprises a block having no specially designed blades or equivalent members for penetrating soil. Also, the tether is attached directly to the buried block, rather than being attached to a rod above the ground.

None of the above inventions and patents, taken either singly or in combination, is seen to describe the instant invention as claimed.

SUMMARY OF THE INVENTION

The present invention provides a ground anchor for tying down a structure to a subterranean anchor. The novel anchor has superior resistance to subterranean displacement or movement, while having unusually uncomplicated structure. The novel ground anchor comprises a block providing a dead mass, and a tether. The block is preferably cylindrical or barrel shaped, and is characterized by a transverse bore extending entirely through the block. The tether is knotted and passed through the transverse bore. The block is then placed in a hole dug beneath a structure being secured, with the free end of the tether emerging from the bore downwardly. The tether partially winds around the block before extending upwardly towards the surface of the soil. Stated another way, the tether is tangent to the block at the point of egress from the bore. The hole is then filled until the block is buried in this orientation.

This arrangement results in highly effective resistance to subterranean displacement or movement of the block. A significant reason for this is that the arrangement of the tether causes the block to respond to pulling forces exerted on the tether to urge the block to tumble in heels-over-head fashion while buried. A greater portion of total surface area of the block thus bears on the soil than occurs in blocks subjected to a simple linear pull.

A further advantage of the novel arrangement is that attachment of the tether to the block is simplified while remaining highly effective. The tether may be knotted and passed through the transverse bore formed in the block. No special fastening means is required, since pulling forces tend to compress the knot as the knot attempts to penetrate the bore, thus preserving integrity of the knot. Separate eyes for tying the tether to the block and other constituent components of the anchor are eliminated. The novel construction requires only a block having a bore, and a tether.

The block may be a parallelepiped, cylindrical, or any other configuration providing a plurality of faces perpendicular to the fill material responsive to rotation urged by torsion due to tangential attachment of the tether.

A preferred material for forming the block is recycled plastics. This is both an efficient use of an otherwise waste material, and also a convenient, cooperative constituent material for the block. Construction from recycled plastic material also provides ecologically sound disposal of waste plastic material. Melting and softening temperatures of recycled plastic are above temperatures conventionally encountered underground.

The use of plastic also replaces the use of concrete. Manufacture of concrete is a significant source of carbon dioxide gas, which has been implicated as promoting global warming by the greenhouse effect. This is because lime kilns traditionally utilize fossil fuels, and also because carbon dioxide is liberated from calcium carbonate.

Plastic material can be formed into a relatively dense block, which will not rise unduly when buried. However, plastic is lighter than steel and concrete, so that bulk shipments are easier to transport and maneuver. Plastic is impervious to deterioration from natural causes, such as infestation by vermin, chemical attack, saturation by water, and the like, while possessing sufficient strength to perform its function. Plastic will not rust or freeze, thereby avoiding problems which may beset concrete.

Plastic has the further properties of being susceptible to fabrication by economical methods so as to avoid potentially injurious sharp edges, unlike steel or even concrete.

Accordingly, it is a principal object of the invention to provide a ground anchor and tether for securing a structure to supporting ground.

It is another object of the invention to enhance effectiveness of resistance to the block of the ground anchor to motion or displacement within the ground when being subjected to pulling forces from above the ground.

It is a further object of the invention to provide effective attachment of the tether to the block.

Still another object of the invention is to maximize surface area of the block bearing against surrounding ground when the anchor is subjected to pulling forces.

An additional object of the invention is to minimize volume of the block.

It is again an object of the invention to minimize the number of separate components which are required to constitute the ground anchor.

Yet a further object of the invention is to utilize recycled waste plastic in fabricating the invention.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
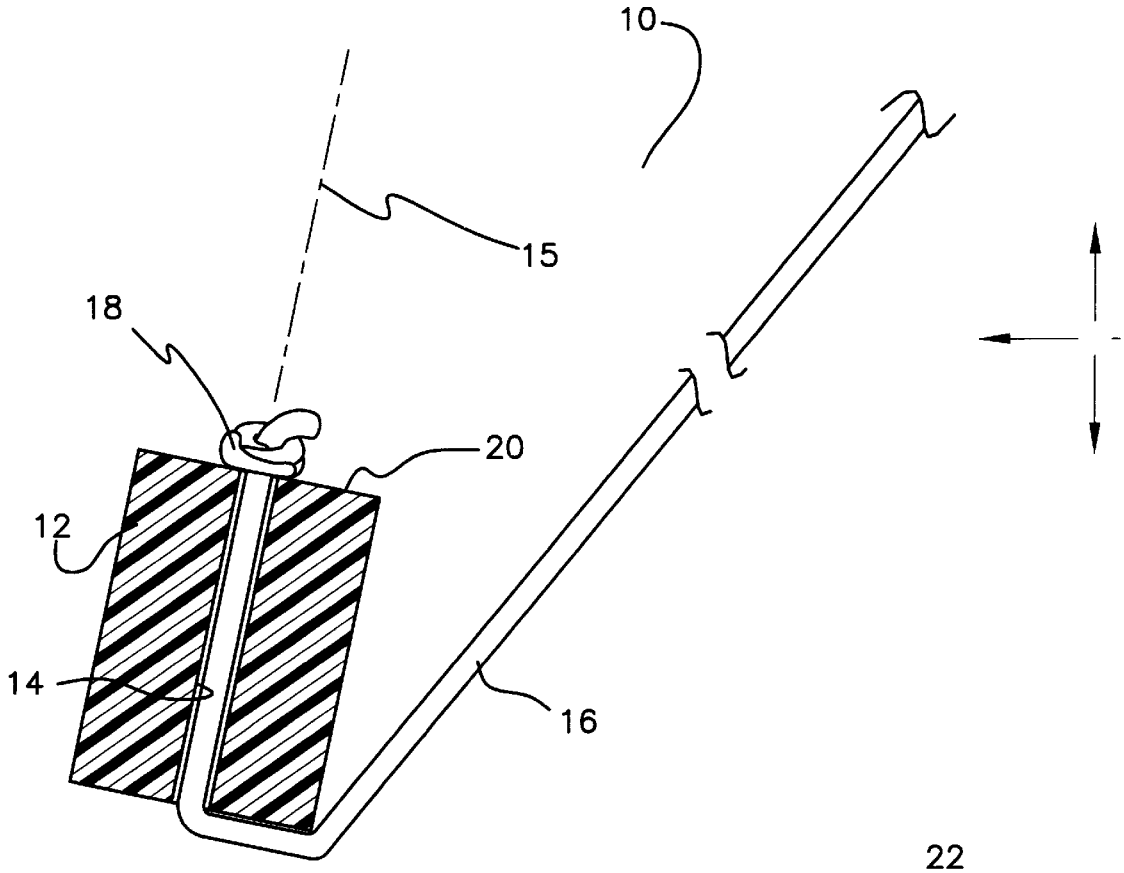
FIG. 1 is a cross sectional view of the novel anchor.

Turning now to FIG. 1 of the drawings, the novel ground anchor 10 is seen to comprise a cylindrical concrete block 12 having a centrally located longitudinal bore 14 extending entirely through block 12, and a flexible tether 16. Longitudinal bore 14 is aligned with the axis 15 of the cylinder of block 12, regardless of whether length of the cylinder is greater or less than the diameter.

The actual configuration of block 12 is not important, so long as it has a plurality of faces which are exposed to surrounding soil, as will be further explained hereinafter. Cylindrical configuration is preferred as maximizing volume given the amount of constituent material of block 12, while still providing satisfactory surface area of faces exposed to surrounding soil. Constituent material of block 12 is preferably recycled plastic, although concrete and other traditional materials may be employed.

Tether 16 has a knot 18 formed at one end. Tether 16 is passed through bore 14 and drawn tight, so that knot 18 lodges against the upper surface 20 of block 12. Tether 16 may be of any suitable flexible material, such as braided nylon, stranded steel, or any other material suitable for conditions of the application.

Figure 2:
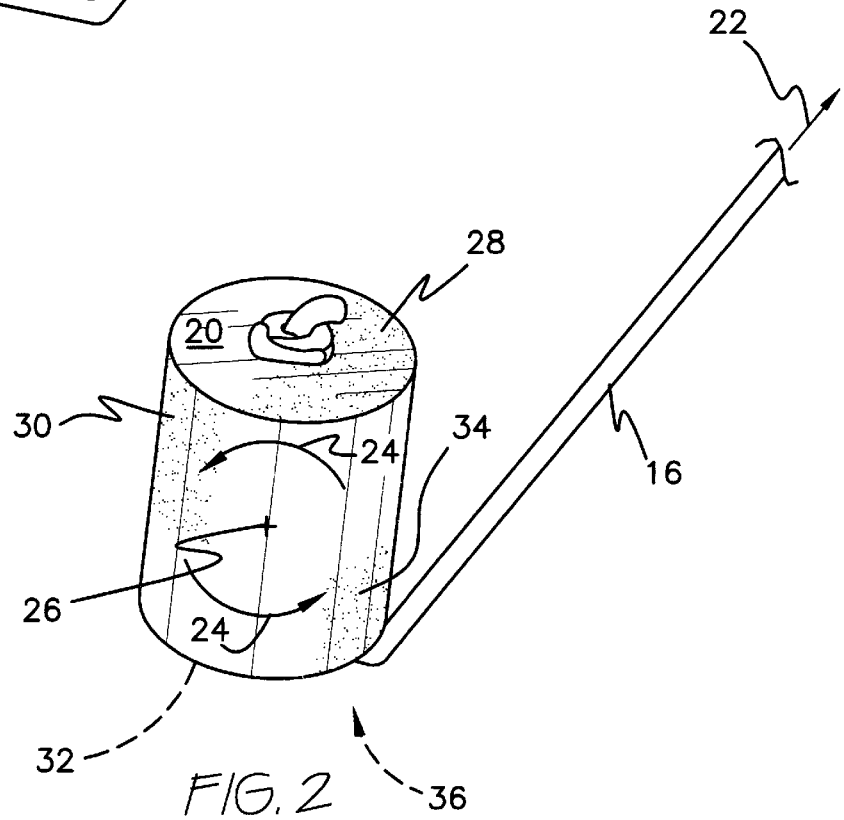
FIG. 2 is a side perspective view of the novel anchor.

FIG. 2 shows why the novel arrangement is effective. When a pulling force, represented by arrow 22, acts on tether 16, block 12 experiences a torque, represented by arrows 24, acting about an axis 26. As block 12 is urged to rotate about axis 26, four areas, or zones 28, 30, 32, 34, of the various faces of block 12 bear against the ground. Zone 28 comprises half of upper surface 20. As zone 28 attempts to move in a counterclockwise direction, it encounters soil (see FIG. 3), which exerts a resistive force.

In addition to zone 28, three additional zones 30, 32, 34 make corresponding contributions to resistance to motion of block 12. Zones 30 and 34 comprise, respectively, the forward moving halves of front and rear faces of the cylindrical surface of block 12. Of course, designation of the faces as front and rear is arbitrary, and is merely for purposes of explanation. In a similar vein, zone 28 has a counterpart in the form of zone 32, which is defined at the bottom face 36 of block 12. Top surface 20 and bottom surface 36 are, of course, arbitrary designations for explanatory purposes, and could be reversed to similar effect.

Figure 3:
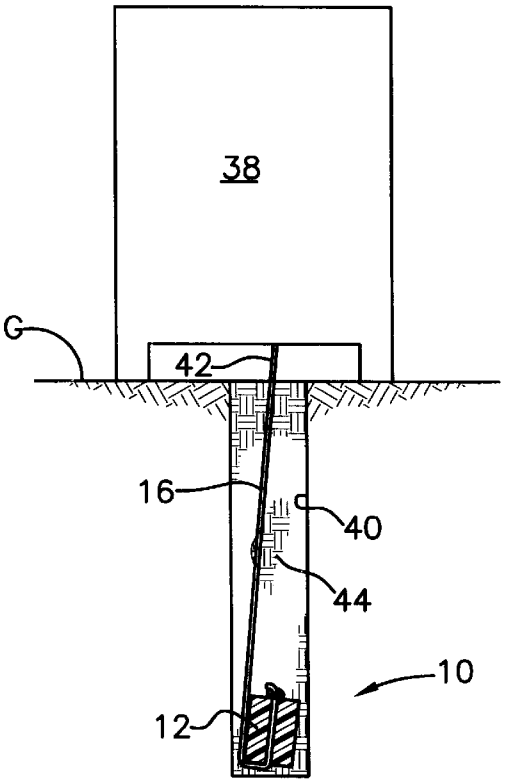
FIGS. 3 and 4 are environmental, side elevational, partly cross sectional views of the invention, illustrating two representative installations of the invention.

Having discussed the principles of operation, a sample or representative installation is depicted in FIG. 3, wherein a structure 38 is secured on supporting ground G by one anchor 10. The installation depicted would be appropriate for a small structure 38, such as a mail collection box or a vending machine. A hole 40 is dug beneath structure 38, and anchor 10 is lowered into hole 40.

As described above, tether 16 is arranged to emerge from block 12 at a downwardly facing surface. Tether 16 then partially winds around block 12, and then is arranged to emerge from bore 14 of block 12 in a direction away from structure 38, and to extend upwardly towards structure 38 from block 12. Tether 16 thus projects away from block 12 in a direction other than that at which tether 16 emerges from the bore 14.

With knot 18 formed at the distal end of tether 16, proximal end 42 of tether 16 is suitably tied or attached to structure 38. Hole 40 is suitably filled with a support medium, such as backfill dirt 44, thereby burying or entrapping block 12 in hole 40. Movement of structure 38 must then overcome the weight of block 12 and also resistance to movement or displacement of block 12 with respect to backfill dirt 44 and ground G.

Figure 4:
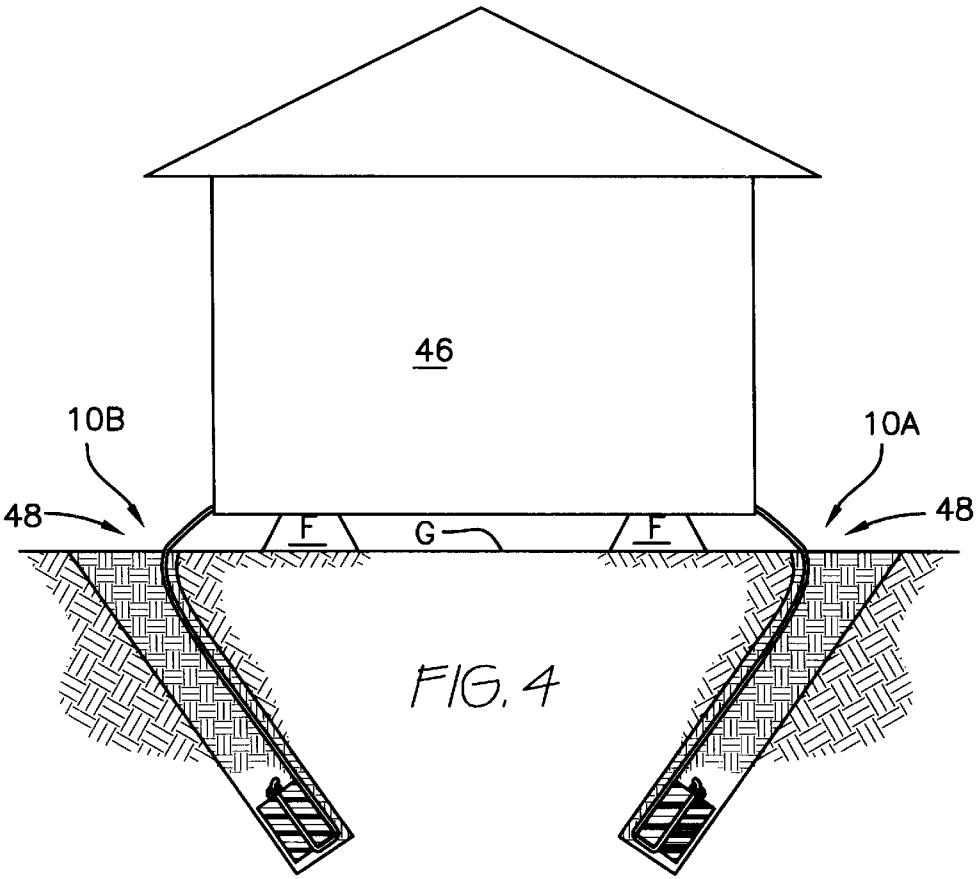

FIG. 4 illustrates a similar installation, but greater in scope. A building structure 46, typical of a trailer or storage shed, is supported above ground G on foundation members F by plural ground anchors. It is contemplated that for typical rectangular building structures, one anchor 10 be provided at each corner of the structure. In this view, anchors 10A and 10B are visible, and two additional anchors (not shown) would also be attached to the remaining two corners of structure 46. Bends 48 in tethers 16 may be reinforced in any suitable manner, so that tethers 16 do not migrate through ground G over time.

Figure 5:
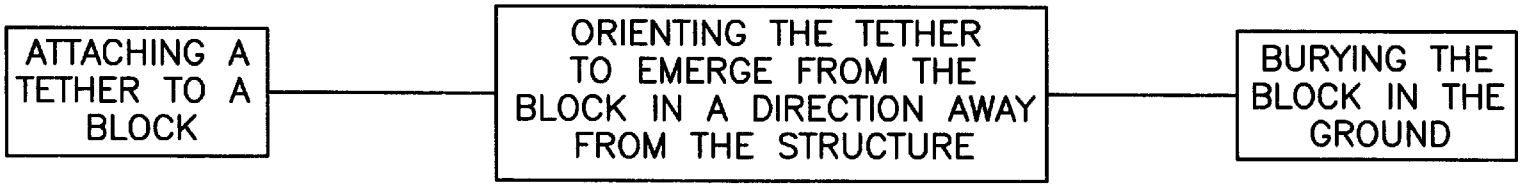
FIG. 5 is a block diagram summarizing steps of a basic method of assembling the novel ground anchor, and is read from left to right.
Figure 6:
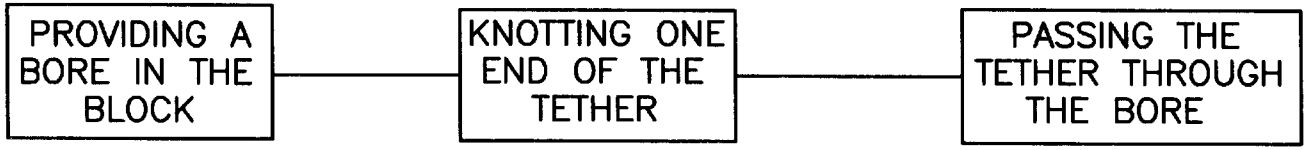
FIG. 6 is a block diagram summarizing steps of an alternative to the method of FIG. 5.

Referring now to FIG. 5, steps of a method of practicing the invention are shown. The basic steps are a) attaching a tether to a block; b) orienting the tether to emerge from the block in a direction away from the building being secured; and c) burying the block in the ground proximate the building. To obtain the benefits of uncomplicated yet effective attachment of tether 16 to block 12, and referring now to FIG. 6, the above method may be modified such that step a) comprises the further steps of d) providing a transverse bore in the block; e) knotting one end of the tether; and f) passing the tether through the transverse bore.

It is not critical to the invention that attachment of tether 16 to block 12 be accomplished by interference of knot 18 with block 12. If desired, tether 16 may be permanently attached to block 12, such as by clamping, or embedding tether 16 within block 12 at the time of casting or molding block 12. Regardless of the actual method of attachment, it is important that tether 16 be arranged to exert a tangential but not purely radial force on block 12 responsive to pulling forces imposed upon tether 16 from above.

It will be understood that several aspects of practicing the invention will be determined for each application. Dimensions of block 12 and hole 40, for example, will be determined after considering conditions of the individual endeavor. Number and location of anchors 10 must be similarly determined.

It is to be understood that the present invention is not limited to the embodiments described above, but encompasses any and all embodiments within the scope of the following claims.

I claim:

1. A tie-down type ground anchor construction in combination with a building structure, said building structure secured to supporting ground by said anchor, said combination comprising:

a building structure;

a block for providing weight and surface area;

a flexible tether having a proximal end attaching to said structure, and a distal end attaching to said block; and a support medium burying said block in the supporting ground below said structure, said block having a centrally located bore extending entirely through said block, said distal end of said tether terminating in a knot, said tether passing through said bore with said knot lodged against said block, said tether emerging from said bore in a direction away from said structure, wrapping around said block, and projecting away from said block towards said structure and attaching to said structure, whereby said tether is attached to said block with said ground anchor construction requiring only said tether and said block to attach said tether to said block, and said structure is anchored in the ground.

2. The ground anchor construction in combination with a building structure according to claim 1, said block being fabricated from recycled plastic material.

3. A method for securing a structure to surrounding ground, comprising the steps of:

providing a structure having a tether attached thereto;

providing a cylindrical block having a bore extending along the central axis of the block and entirely through the block;

extending said tether from said structure to said block and passing said tether through said bore in said block;

knotting the end of the tether which is opposite said structure;

orienting the tether to emerge from said block in a first direction, winding the tether around the block, and causing the tether to project away from the block in a second direction other than at which the tether emerges from the block;

lowering the block into a hole formed in the ground and burying said block in the ground.

* * * * *